United States Patent [19]

Kawai

[11] Patent Number: 4,809,817

[45] Date of Patent: Mar. 7, 1989

[54] APPARATUS FOR CONTROLLING ELEVATOR AT OCCURRENCE OF EARTHQUAKE

[75] Inventor: Kiyoji Kawai, Inazawa, Japan

[73] Assignee: Mitsubishi Denki Kabushiki Kaisha, Japan

[21] Appl. No.: 29,988

[22] Filed: Mar. 25, 1987

[30] Foreign Application Priority Data

Mar. 27, 1986 [JP] Japan ..... 61-68935

[51] Int. Cl.[4] ..... B66B 13/24

[52] U.S. Cl. ..... 187/107

[58] Field of Search ..... 187/107

[56] References Cited

U.S. PATENT DOCUMENTS

| | | | |
|---|---|---|---|
| 3,792,759 | 2/1974 | Kirsch | 187/29 R |
| 4,382,489 | 5/1983 | Sizuki | 187/107 |
| 4,649,751 | 3/1987 | Onoda | 187/107 X |
| 4,653,611 | 3/1987 | Ohta et al. | 187/107 |
| 4,690,251 | 9/1987 | Onoda | 187/107 |

OTHER PUBLICATIONS

Suzuki, "Earthquake-Emergency Landing Device with a Primary-Wave Sensor for Elevators", Mitsubishi Electric, 3/81, pp. 10-11.

*Primary Examiner*—Jerry Smith
*Assistant Examiner*—Steven G. Kibby
*Attorney, Agent, or Firm*—Leydig, Voit & Mayer

[57] ABSTRACT

A controller for deciding the safety of continued elevator operation during and following an earthquake based on a comparison of currently detected seismic intensity data with stored historic intensity data. In the event the current intensities are greater than all stored data or equal to an occurrence in which faults were detected, operation is suspended at the nearest floor until a fault detection is completed. New seismic data is automatically stored along with the presence or absence of fault conditions.

8 Claims, 4 Drawing Sheets

APPARATUS FOR CONTROLLING ELEVATOR AT OCCURRENCE OF EARTHQUAKE

BACKGROUND OF THE INVENTION

This invention relates to an apparatus for controlling an elevator at the occurrence of an earthquake, which operates the elevator safely when an earthquake occurs.

A prior-art apparatus for operating an elevator at the occurrence of an earthquake is disclosed in Japanese patent application publication No. 42155/1973, in which when an earthquake sensor had been activated, a cage is quickly stopped at the nearest floor at which it can stop, irrespective of the scale of the earthquake wih the highest priority given to safety, whereby the elevator is stopped and rendered unserviceable. Further, there has recently been adopted a passive safety measure wherein, as stated in the "Manual of Technical Standards of Elevators" (issued by the Japan Elevator Association), 1984 issue, p. 256, a plurality of earthquake sensors are installed, the scale of an earthquake is decided after the lapse of a predetermined time limit as determined by the combined output states of the plurality of earthquake sensors (a time limit at which the earthquake is predicted to have ended), and depending on the scale only an elevator is automatically reset to resume normal operation at the time of a small-scale earthquake, whereas the elevator is taken out of services without regard to the presence or absence of any damage at the time of a large-scale earthquake.

More specifically, the safety system has a low-level earthquake sensor which operates upon sensing a low-level earthquake, and a medium-level earthquake sensor which operates upon sensing a medium-level earthquake. When either of the sensors operates, a cage is forcibly stopped at the nearest floor possible, and the elevator is rendered unserviceable. Thereafter, the scale of the earthquake is determined upon the lapse of a period of time in which the earthquake is anticipated to end. When the level of the earthquake is low, it is presumed that there is no damage to the elevator system, and the elevator is automatically reset to the normal state of operation and rendered serviceable after the lapse of the predetermined period of time. On the other hand, when the level of the earthquake is medium or above, it is presumed that there is damage to the elevator system and that the elevator should be taken out of service and whether or not any damage to any of the elevator's parts is checked by performing an inspection operation. After the completion of the inspection operation, in the absence of any abnormality, the elevator is reset to resume normal operation, whereas in the presence of any abnormality, the elevator is held out of service until the malfunctioned part is repaired.

As stated above, the apparatus for operating the elevator at the occurrence of an earthquake has been constructed relying entirely on the decision based on the presumption.

Since the prior-art apparatuses for controlling an elevator at the occurrence of an earthquake are constructed as described above, an operating system with safety taken into consideration when viewed from the users' side of the elevator is provided. However, since small earthquakes happen frequently, the elevator becomes unusable temporarily or for a predetermined time on each occasion. This had led to the problem that, for the sake of safety, the performance of the elevator, which is an important means of transportation in the vertical direction of buildings is sometimes lowered, resulting in sluggish elevator service in the building.

Further, even in a range exceeding the small earthquakes, all earthquakes do not inflict damages to the elevator system. In this regard, there has been the problem that the elevator becomes unusable at the occurrence of such an earthquake.

SUMMARY OF THE INVENTION

This invention has the objective of overcoming problems as stated above, and has for its main object to provide an apparatus for controlling an elevator at the occurrence of an earthquake in which, when the earthquake occurred, the presence or absence of damage to any of the elevator's parts is checked on the basis of the scales of past earthquakes, to decide whether or not the current earthquake will inflict damage to any of the elevator's parts, and subject to the earthquake inflicting no damage, ordinary operation is maintained even after the occurrence of the earthquake, so that only in case of an earthquake which truly causes damage, a cage is stopped at the nearest floor possible, whereby stopping of service due to small-scale earthquakes can be prevented.

Further, when an earthquake which is larger in scale than the earthquakes heretofore registered occurs, the cage is stopped to the nearest floor at which it can stop. On this occasion, whether or not damage was inflicted to any of the elevator's parts is checked. The checked result can also be stored as data for future earthquakes.

The apparatus for operating an elevator at the occurrence of an earthquake according to this invention has a construction comprising earthquake sensing means disposed in at least one place of a machinery room and a hoistway of the elevator, earthquake memory means for storing seismic intensity data of the earthquake sensed by said earthquake sensing means, fault storage means for storing data as to a fault which is detected in any of the elevator's parts each time an earthquake is sensed by said earthquake sensing means, and earthquake-occurrence-condition operation control means, supplied with both the seismic intensity data of said earthquake memory means and fault data of said fault outbreak storage means, for deciding the safety of an elevator operation on the basis of the data items so as to control the elevator operation.

The earthquake-occurrence-condition operation control means in this invention decides the safety of the elevator operation as to the individual earthquake and then controls the elevator operation, whereby the elevator operation is suspended only for earthquakes jeopardizing safety and is continued for earthquakes of a degree not jeopardizing the safety.

BRIEF DESCRIPTION OF THE DRAWINGS

Throughout the drawings, the same symbols indicate identical or corresponding portions.

DESCRIPTION OF THE PREFERRED EMBODIMENT

Figure 1:
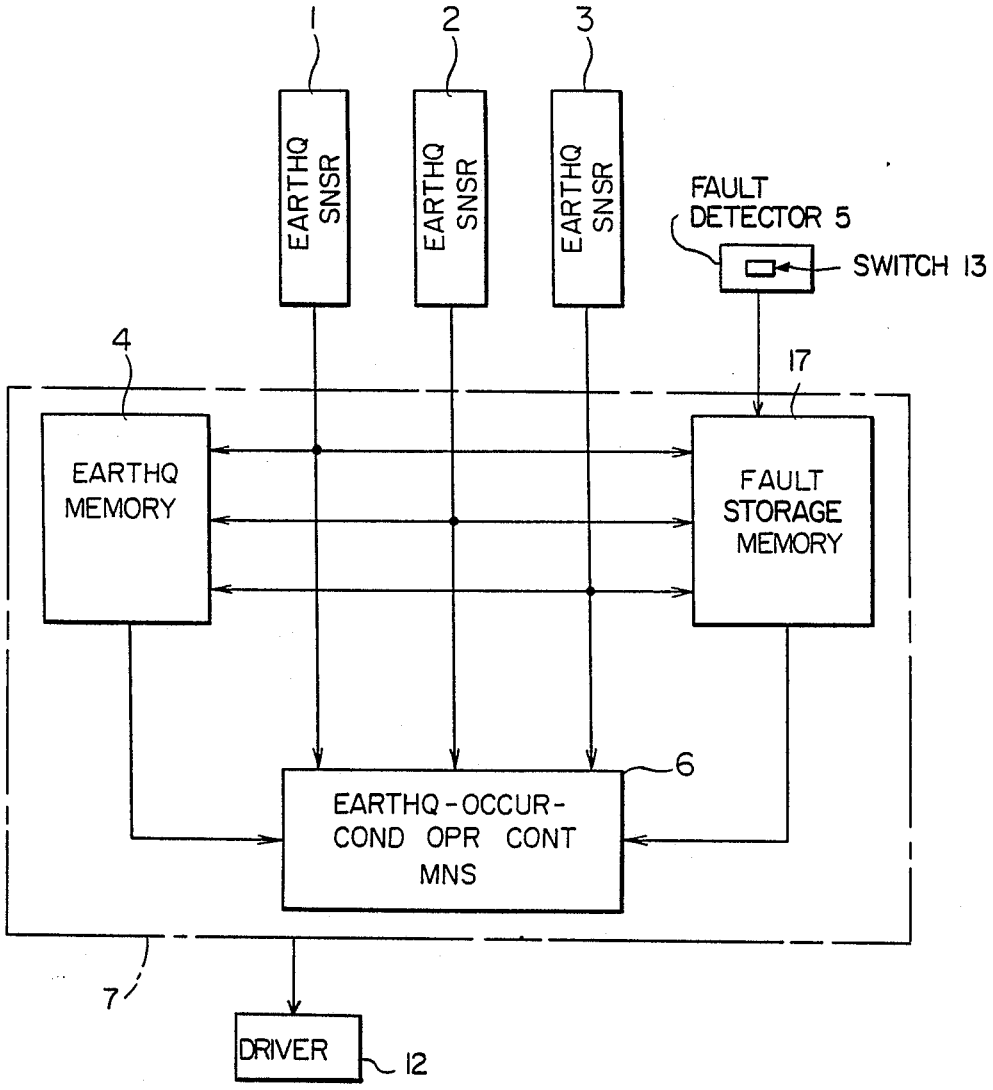
FIG. 1 is a general arrangement diagram of an embodiment of this invention.

Now, an embodiment of this invention will be described with reference to FIG. 1 thru FIG. 4(*b*). FIG. 1 shows a general arrangement diagram of the present invention, FIG. 2 shows an arrangement diagram of an elevator controlling microprocessor in the present embodiment, FIG. 3 shows a flow chart of the processing steps carried out in the embodiment, and FIGS. 4(*a*) and 4(*b*) show diagrams of the detailed storage aspects of earthquake storage and fault outbreak storage means.

Figure 2:
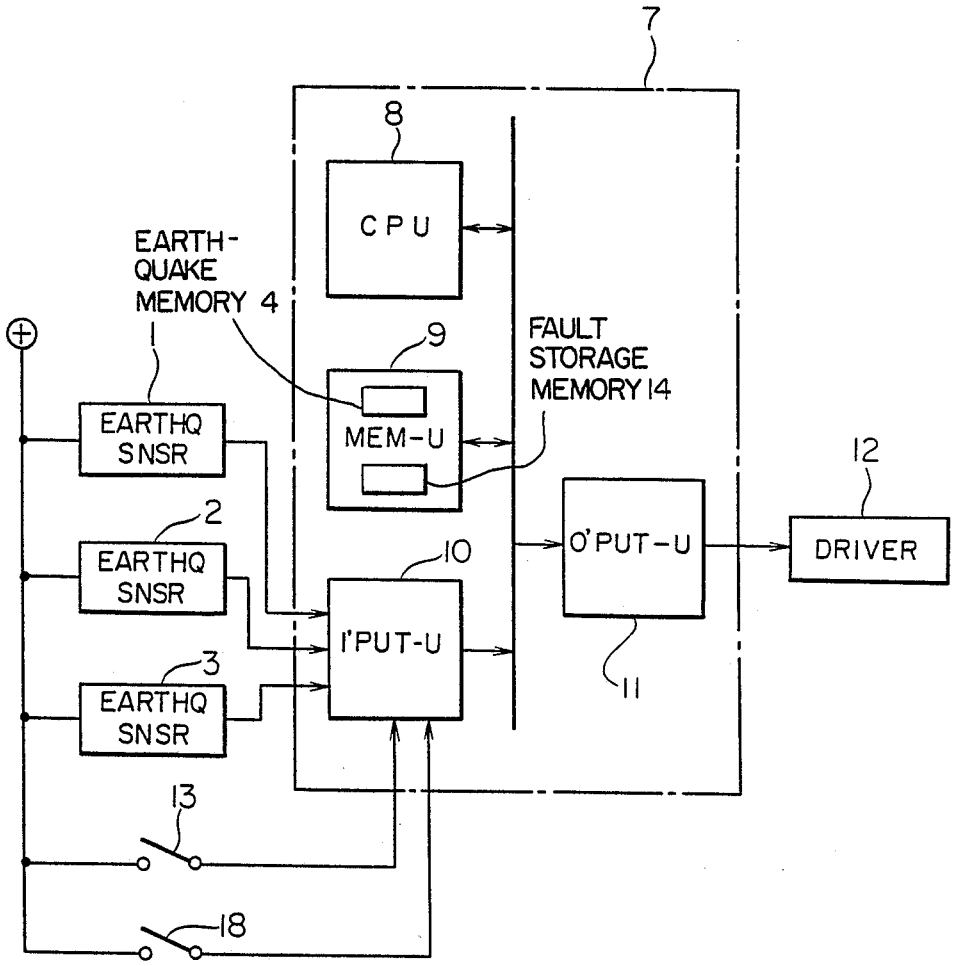
FIG. 2 is an arrangement diagram of an elevator controlling microprocessor.
Figure 3:
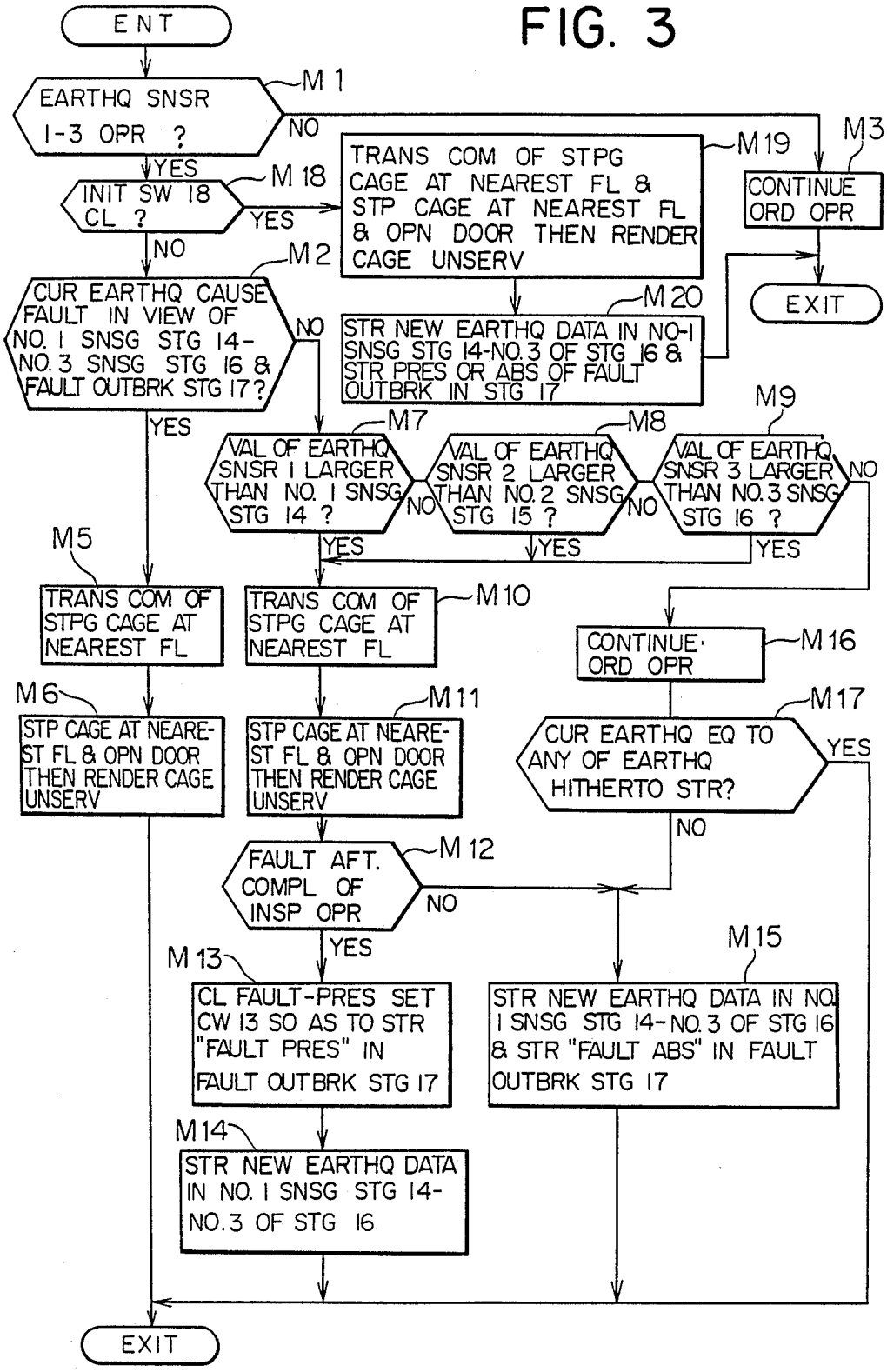
FIG. 3 is a flow chart of the processing steps.
Figure 4A:
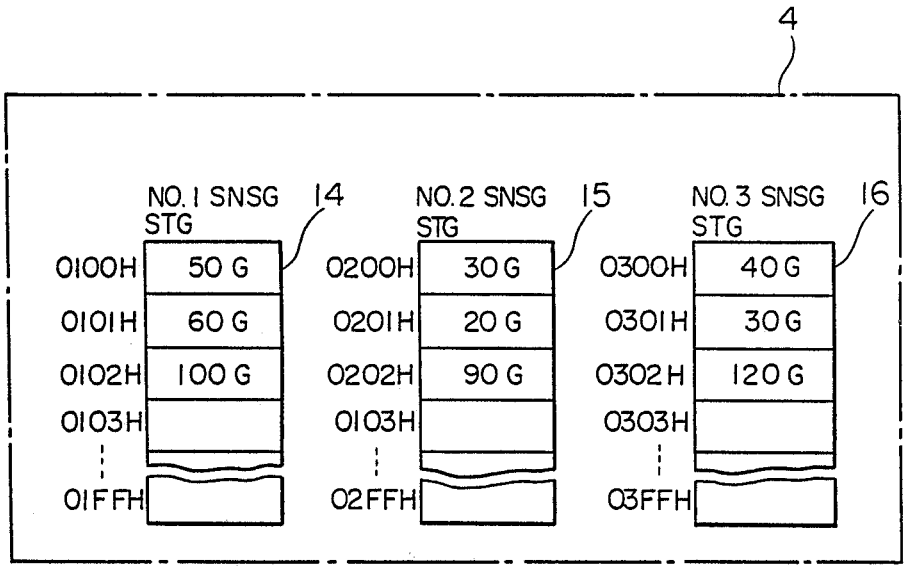
FIG. 4(*a*) is a diagram of the storage aspect of earthquake memory means, while FIG. 4(*b*) is a diagram of the storage aspect of fault outbreak detection means.
Figure 4B:
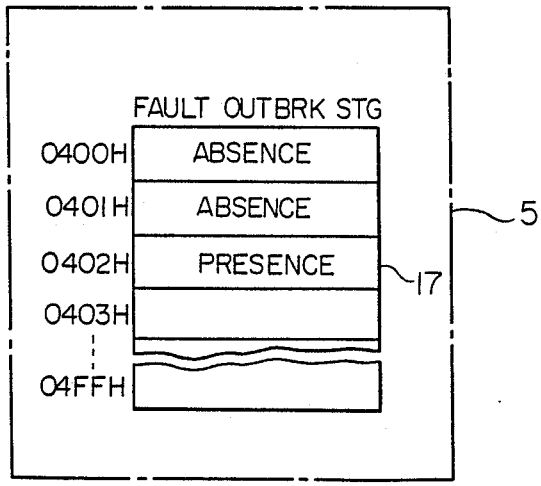

Referring especially to FIGS. 1 and 2, numeral 1 designates an earthquake sensor which is installed in the machinery room of an elevator and which determines the level of an earthquake in 10 gal divisions at the occurrence thereof, numeral 2 a similar earthquake sensor which is installed at the upper part of the hoistway of the elevator, and numeral 3 a similar earthquake sensor which is installed at the lower part of the hoistway. Earthquake memory means 4 stores the levels of the earthquake sensed by the respective sensors 1, 2 and 3. Fault outbreak detection is registered by a means 5 which supplies a fault-representing signal to the storage means 17 which stores the signal as data representing the presence or absence of a fault in any of the elevator devices during each earthquake. Earthquake-occurrence-condition operation control means 6 provides the cage of the elevator with a stop command for stopping the car at the nearest floor, in a case where the operation of the elevator is dangerous due to the occurrence of the earthquake. Numeral 7 indicates an elevator controlling microprocessor.

The elevator controlling microprocessor 7 is composed of a central processing unit 8, a memory unit 9, an input unit 10 which receives external information, and an output unit 11. Having an elevator controlling D.C. power source (+), the microprocessor 7 accepts the data items from the earthquake sensors 1, 2 and 3 and receives a command signal representing the presence of a fault from a switch 13. The output unit 11 delivers a stop/start command to a driver 12. The switch 13 for the setting of a command signal representing the presence of a fault after the completion of an inspection operation is closed when a fault has been found and serves as the means 5 of FIG. 1 in the manual embodiment illustrated. Shown at numeral 18 is an initializing command switch, which is closed when the microprocessor is to be initialized.

Next, the operation of this embodiment will be described with reference to FIG. 3. First, there will be described a case where an earthquake has occurred, but where the scale of the earthquake falls within the range of earthquakes stored in the earthquake memory means 4 and where no fault in the machiner occurs. It is assumed that the earthquake sensor 1 measures a value of 60 gals, that the earthquake sensor 2 measures a value of 20 gals and that the earthquake sensor 3 measures a value of 30 gals.

At a step M1, either one of the earthquake sensors 1–3 have operated, so that the control flow proceeds to a step M18. If the initializing switch 18 is not closed, the step M18 is followed by a step M2. Unless the earthquake sensors 1–3 have operated, the control flow proceeds to a step M3, and ordinary operation is continued as is well known.

At the step M2, whether or not a fault will occur due to a current earthquake is decided by referring to the historic intensity data of past seismic events stored in the earthquake memory means 4 and the stored fault data in the fault storage 17 of the means which provides data as to the presence or absence of a fault during past earthquakes of an intensity equal to or less than the current earthquake. More specifically, the levels of the current earthquake sensed by the respective sensors 1–3 are compared with the historic intensity data of past seismic events stored in No. 1 sensing storage 14–No. 3 sensing storage 16 (indicated in FIG. 4(*a*)), and, if a match is found, the outbreak of a fault attributed to the current earthquake is decided using fault outbreak storage 17 (indicated in FIG. 4(*b*)). Upon deciding that no fault will break out, the step M2 is followed by a step M7. At the step M7, the level of intensity of the current earthquake is compared with the historic data of No. 1 sensing storage 14. If the current earthquake is an earthquake which is equal to or lower than any of the seismic intensities stored, the control flow proceeds to a step M8. At the step M8, the level of the current earthquake intensity is compared with the data of No. 2 sensing storage 15 in the same manner as at the step M7, and if the current earthquake is an earthquake which is equal to or lower than any of the seismic intensities hitherto stored, the control flow proceeds to a step M9. The step M9 is also similar to the stp M7, and it compares the level of intensity of the current earthquake with the historic data of No. 3 sensing storage 16. If the current earthquake is an earthquake which is equal to or lower than any of the seismic intensities hitherto stored, the control flow proceeds to a step M16. Here, ordinary operation is maintained without stopping the cage at the nearest floor in spite of the occurrence of the earthquake. Thereafter, the control flow proceeds to a step M17, which decides whether or not the current earthquake is the same as any of the earthquakes hitherto stored. If the current earthquake is the same as one of the past earthquakes, new data for the sensing storage of the earthquake memory means 4 is not generated. Unless the current earthquake is same as in the past, the step M17 is followed by a step M15, at which new data items are generated for No. 1 sensing storage 14–No. 3 sensing storage 16, and besides, data indicating the absence of the outbreak of any fault is generated for the fault outbreak storage 17 because, in this case, no fault was found to break out on the basis of the past stored information.

Next, a case is assumed where the scale of an earthquake is larger than that of any of the earthquakes hitherto stored and where the earthquake sensor 1 exhibits 50 gals, the earthquake sensor 2 exhibits 100 gals and the earthquake sensor 3 exhibits 50 gals. The step M1 executes the same processing as in the foregoing, whereupon the control flow proceeds to the step M18 and then to the step M2. At the step M2, the level of intensity of the current earthquake is compared with the contents of the earthquake memory means 4. If the seismic intensity sensed by the earthquake sensor 2 exceeds the scale of any of the earthquakes hitherto stored, the presence or absence of an outbreak of any fault during the past is not stored, and hence, the control flow proceeds to the step M7. At the step M7, the value of the sensor 1 is compared with the data of No. 1 sensing storage 14 and since it does not exceed the range of the values hitherto stored, the control flow proceeds to the step M8. At this step M8, the value of the sensor 2 is compared with the data of No. 2 sensing storage 15 and since it exceeds the range of the values hitherto stored, the control flow proceeds to a step M10. Since the current earthquake has an intensity which has hitherto not been stored, the command of stopping the cage at the nearest floor is output for the sake of safety.

At the next step M11, the cage is stopped at the nearest floor and has its door opened, and it is thereafter rendered unserviceable. Subsequently, an inspection operation is performed in order to reset the elevator to the ordinary operation as is well known. If any fault is found, the control flow proceeds from a step M12 to a step M13 after the completion of the inspection operation. At the step M13, when the switch 13 for setting the presence of the fault is closed, a fault-presence flag is set in the fault outbreak storage 17 of the fault outbreak detection means 5 representing a fault having occurred at the current earthquake. In addition, the step M13 is followed by a step M14, at which the intensity data of the current earthquake are stored in No. 1 sensing storage 14–No. 3 sensing storage 16 of the earthquake memory means 4.

Lastly, there will be explained a case where the scale of intensity of a current earthquake is equal to that of an earthquake which has been stored and where fault outbreak data corresponding thereto is stored. It is assumed that the earthquake sensor 1 exhibits 100 gals, that the earthquake sensor 2 exhibits 90 gals and that the earthquake sensor 3 exhibits 120 gals. The step M1 is the same as in the foregoing, whereupon the control flow proceeds to the step M18 and then to the step M2. At the step M2, the level intensity of the current earthquake is compared with the contents of the earthquake memory means 4, and the presence or absence of the outbreak of any fault is decided by referring to the data stored in the fault storage 17 of the means 5. Since the current earthquake has the values as mentioned above, it corresponds to the fault data "presence" (see FIG. 4*b*) in the fault outbreak storage 17, and hence, the control flow proceeds to a step M5. At the step M5, the command of stopping the cage at the nearest floor is output for the sake of safety. Further, the control flow proceeds to a step M6, at which the cage is stopped at the nearest floor and has its door opened and is thereafter rendered unserviceable.

Next, there will be explained the initialization of the sensing storages 14–16 and the fault outbreak storage 17. During the occurence of all earthquakes which occurred after the installation of this apparatus, the cage is stopped at the nearest floor in consideration of safety. The individual earthquakes are successively recorded as the sensing storages 14–16. After the inspection operation of each of the individual earthquakes, the presence or absence of any fault is stored in the fault outbreak storage 17 by the use of the fault-presence setting switch 13 of the manual type. After the completion of the initialization, the control operation described above is started.

A concrete method for the initialization is as follows: For the initialization, the initializing switch 18 is closed beforehand. When an earthquake occurs, the control flow proceeds from the step M1 to the step M18. Since, at the step M18, the initializing switch 18 is closed as stated above, the control flow proceeds to a step M19. Here, the cage is stopped at the nearest floor for the sake of safety and has its door opened, and it is thereafter rendered unserviceable. At the next step M20, the sensing storages 14–16 and the fault outbreak storage 17 are initialized. By way of example, as regards the first earthquake which occurred, the value of intensity exhibited by the earthquake sensor 1 is stored in the address 0100H of No. 1 sensing storage 14, that of the earthquake sensor 2 is stored in the address 0200H of No. 2 sensing storage 15, and that of the earthquake sensor 3 is stored in the address 0300H of No. 3 sensing storage 16. In addition, the presence or absence of the outbreak of any fault on this occasion is stored in the address 0400H of the fault outbreak storage 17. Thereafter, at the occurrence of the second earthquake, new data items are stored in the plus-one addresses of the respective storage devices. Upon the completion of the initialization, the initializing switch 18 is opened.

Modified embodiments can be constructed as stated below:

(1) Although three earthquake sensors have been described, any number of sensors may be used.

(2) It has been described that, each time an earthquake occurs, the presence of any fault is manually set. It is also possible, however, to mount fault sensors on respective elevator devices and to automatically set the sensed results of the sensors.

(3) Although the earthquake sensors have been set at intervals of 10 gals, smaller values or larger values can be used.

(4) The initializing method has been described as the expedient which sets the gal values and the presence or absence of a fault outbreak at the occurrence of actual earthquakes. It is also possible, however, to utilize preset calculated values estimated to be safe or to use the statistic data of another building which had the same elevator system installed in the past.

As described above, according to this invention, when an earthquake occurrs, a cage is not immediately stopped at the nearest floor and rendered unserviceable, but whether or not the further continuation of the operation of the elevator is safe is decided using earthquake memory means and fault outbreak detection and storage means. Therefore, the shifting of a cage out of service upon the occurrence of each earthquake is eliminated, and the cage is stopped at the nearest floor and is rendered unserviceable only when truly dangerous earthquakes occur dependent upon the characteristics of each individual building. This produces the effect that, while a safe elevator operation at the occurrence of an earthquake is ensured, the serviceability of the elevator can be enhanced.

What is claimed is:

1. An apparatus controlling an elevator at the occurrence of an earthquake comprising earthquake sensing means disposed in the elevator, earthquake memory means for storing seismic intensity data of earthquakes sensed by said earthquake sensing means, fault storage means for storing data as to a fault detected in a part of the elevator each time an earthquake is sensed by said earthquake sensing means, and earthquake-occurrence-condition operation control means supplied with both the seismic intensity data of said earthquake memory means and the fault data of said fault storage means, for deciding the safety of continued elevator operation based on a comparison of sensed current earthquake seismic intensity data with stored historic seismic intensity data and stored fault data corresponding to specific historic events, and suspending elevator operation when current seismic intensity data is greater than all historic event intensity data or equal to intensity data of an historic event in which a fault occurred.

2. An apparatus controlling an elevator at the occurrence of an earthquake as defined in claim 1 wherein said earthquake sensing means comprises a plurality of earthquake sensors disposed in predetermined places of a machinery room and a hoistway of the elevator.

3. An apparatus controlling an elevator at the occurrence of an earthquake as defined in claim 2 wherein, where current seismic intensity data obtained when an earthquake is sensed by said earthquake sensing meas is greater than historic seismic intensity data stored in said earthquake memory means, said earthquake memory means stores the current seismic intensity data, and said fault storage means stores fault data concerning the sensed earthquake.

4. An apparatus controlling an elevator at the occurrence of an earthquake as defined in claim 2 wherein, where the current seismic intensity data obtained when an earthquake is sensed by said earthquake sensing means is smaller than the historic data stored in said earthquake memory means, said earthquake-occurrence-condition control means does not interrupt the operation of the elevator system.

5. An apparatus controlling an elevator at the occurrence of an earthquake as defined in claim 1 wherein, where current seismic intensity data obtained when an earthquake is sensed by said earthquake sensing means is greater than historic seismic intensity data stored in said earthquake memory means, said earthquake memory means stores the current seismic intensity data of the sensed earthquake, and said fault storage means stores fault data concerning the sensed earthquake.

6. An apparatus controlling an elevator at the occurrence of an earthquake as defined in claim 5 wherein, where the current seismic intensity data obtained when an earthquake is sensed by said earthquake sensing means is smaller than the historic data stored in said earthquake memory means, said earthquake-occurrence-condition control means does not interrupt the operation of the elevator system.

7. An apparatus controlling an elevator at the occurrence of an earthquake as defined in claim 1 wherein, where the current seismic intensity data obtained when an earthquake is sensed by said earthquake sensing means is smaller than the historic data stored in said earthquake memory means, said earthquake-occurrence-condition control means does not interrupt the operation of the elevator system.

8. A method for controlling an elevator at the occurrence of an earthquake comprising the steps of:

sensing seismic intensity data as to each earthquake;

storing the sensed seismic intensity data of each earthquake;

storing data as to a fault in a part of the elevator each time an earthquake is sensed and a fault is detected;

comparing sensed current earthquake seismic intensity data with stored historic seismic intensity data, deciding the safety of continued elevator operation based on the comparison and on stored fault data; and suspending elevator operation when current seismic intensity data is greater than all historic seismic intensity data or equal to intensity data of an earthquake in which a fault occurred.

* * * * *